United States Patent [19]

Steinbock

[11] 4,307,594

[45] Dec. 29, 1981

[54] DELIVERY SYSTEM FOR HOT-ROLLED WORKPIECES

[76] Inventor: Rolf Steinbock, 603 Lindsay Rd., Carnegie, Pa. 15106

[21] Appl. No.: 98,264

[22] Filed: Nov. 28, 1979

[51] Int. Cl.[3] ..... B21B 43/08; B23D 25/12

[52] U.S. Cl. ..... 72/201; 72/203; 83/149; 83/158; 83/161; 83/306

[58] Field of Search ..... 72/201, 200, 202, 203; 83/158, 161, 306, 149, 167, 155, 155.1, 91, 157, 163

[56] References Cited

U.S. PATENT DOCUMENTS

| | | | |
|---|---|---|---|
| 653,506 | 7/1900 | Edwards | 83/158 X |
| 2,348,491 | 5/1944 | O'Malley et al. | 83/306 |
| 2,809,545 | 10/1957 | Norlindh | 72/203 |
| 3,602,028 | 8/1971 | Kluamler et al. | 72/201 |
| 3,621,696 | 11/1971 | Norlindh | 72/201 |
| 3,851,556 | 12/1974 | Sieurin | 83/306 X |
| 4,054,047 | 10/1977 | Sclippa | 72/201 |
| 4,062,259 | 12/1977 | Sclippa | 83/306 X |
| 4,080,859 | 3/1978 | Polhäll et al. | 83/306 |

*Primary Examiner*—Frank T. Yost

*Attorney, Agent, or Firm*—Thomas H. Murray; Clifford A. Poff

[57] ABSTRACT

A workpiece issuing from a rolling mill is directed by a tubular guide to pass above the knives of a flying shear that is driven in a drive train used to rotate a cam used to pivot the guide tube and direct the workpiece into the shear. The workpiece moves beyond the shear into one of a plurality of retardation channels formed in a drum. There may be shock absorbers at their remote ends to prevent escapement of the sheared workpieces in the event they fail to stop by sliding friction. The drum rotates at a relatively slow speed. When a trailing end of a sheared workpiece moves beyond the shear into the drum, the leading end of the remaining length of workpiece enters a laterally-adjacent channel which has moved into the path of travel by the workpiece through rotation of the drum. A conveyor receives workpieces discharged from the drum through rotation thereof and carries them to a remote discharge station where they are loaded into a cradle car.

19 Claims, 6 Drawing Figures

DELIVERY SYSTEM FOR HOT-ROLLED WORKPIECES

BACKGROUND OF THE INVENTION

This invention relates to a delivery system to process a hot workpiece discharged from a rolling mill or the like by subdividing the workpiece into lengths while directing the lengths in succession to a run-out transfer for cooling. More particularly, the present invention relates to such a delivery system to subdivide a rolled workpiece into finished lengths while traveling at a high speed and to direct the successive sheared lengths of workpieces to individual retardation channels for deceleration and transfer in a direction lateral to the extended length of the sheared workpiece.

While not so limited, the present invention is particularly useful in a rolling mill installation where it is desired, at the delivery side of the last mill stand, to handle the workpeice without coiling by subdividing the workpiece, e.g., a rod or a bar, into desired finished lengths while traveling at a relatively high delivery speed of up to 4000 feet per minute or greater. The production of single finished lengths of bar at very high speeds has not been practical before this invention due to shearing, separating and guiding problems. Due to the use of a continuously-running flying shear in combination with synchronized inlet and outlet guiding equipment and a suitable arrangement of all the components, the equipment according to this invention can handle the high speeds and the rapidly repeating cuts required to cut finished salable lengths of bar. Thus, for example, 200 cuts per minute are necessary to produce finished cut lengths of 20 feet when a workpiece is traveling at a speed of 4000 feet per minute. The successive lengths of sheared hot workpieces are cooled and transferred to a cradle for strapping and shipping, thus eliminating the need for recutting and further handling.

It was common practice in the past to deliver the bar product from the last stand of a merchant bar mill to a hot bed where the product was transferred laterally to its extended length across the bed and then fed to a shear for subdivision into desired finished lengths. Even the production of multiples of finished lengths of bar above 1800 feet per minute has been difficult because at this speed, the commonly-used start and stop shears in combination with hot metal detectors and accompanying guiding equipment become unreliable. Bar products of varying cross-sectional shapes can be produced on a cross-country mill at about 800 feet per minute. Other mill arrangements permit the production of such bar products at greater speeds. One such mill arrangement is shown in my prior U.S. Pat. No. 3,945,234. The tandem rolling mill arrangement disclosed in this patent is readily capable of producing bar or rod products down to at least $\frac{3}{8}$ inch in diameter at speeds in excess of 4000 feet per minute. The versatility of the tandem rolling mill arrangement permits its addition to an existing cross-country mill whereby the delivery speed from the mill can be increased to several times the delivery speed of the cross-country mill. A rolling mill installation of this type is particularly suitable for producing small round sections and rebar, although it can be adapted for small shapes.

A handling system for the hot bar issuing from the last stand of the rolling mill must accommodate the high speed of operation without jamming up. The bar product must be severed precisely into desired lengths and the required cooling equipment must be suitable to handle the multitude of workpieces coming from the shear. Moreover, subdividing the workpiece issuing from the mill stand into finished lengths greatly increases the product yield when the mill is coupled to a continuous casting line or other well-known process for supplying long lengths of workpieces to the mill.

A critical requirement of a high-speed delivery system for a rolling mill of the above type is the necessity to separate the tail end of one sheared length from the front end of the following and remaining length of workpiece as an incident to the shearing operation. As the leading length of the sheared workpiece decelerates, it is necessary that the workpiece which immediately follows can slide past the tail end of the decelerating workpiece without interference. Unless this necessary and controlled separation of sheared lengths of workpieces can be achieved, successive workpieces would move into each other during deceleration.

SUMMARY OF THE INVENTION

It is an object of the present invention to provide a high-speed delivery system to process a hot workpiece discharged from a rolling mill or the like at speeds higher than previously possible.

It is also an object of the present invention to provide a high-speed delivery system to subdivide a workpiece into desired, finished and salable lengths.

It is a further object of the present invention to provide a high-speed delivery system wherein a continuously-running flying shear is used to subdivide the workpiece discharged from the rolling mill.

Another object of the present invention is to provide a high-speed delivery system for a rolling mill wherein the workpiece is positioned by a guide in relation to a flying shear for not only severing the workpiece but also for controlling the relative position of the severed ends of the workpieces such that the front end of the trailing length of workpiece can slide past the tail end of the leading length of workpiece without interference for passage onto a run-out transfer having retardation channels for decelerating the sheared lengths of workpieces by sliding friction.

More particularly, according to the present invention, there is provided a delivery system to process a hot workpiece discharged from a rolling mill or the like wherein the delivery system includes shear means having a drive coupled to a movable shear knife to subdivide the workpiece into sections having desired lengths, the shear means having an entry side, a delivery side and a passageway for workpieces to pass by the movable shear knife, entry guide means including a position controller to cyclically position a segmented length of a moving workpiece at the entry side of the shear means between a first position wherein the workpiece is directed for subdivision by contact with the movable shear knife and a second position wherein a workpiece is directed along a path spaced from the movable shear knife to the delivery side of the shear means, run-out transfer means at the delivery side of the shear means receiving successive sheared lengths of hot workpieces for deceleration, cooling and transfer in a lateral direction of the length of the sheared lengths, the run-out transfer means including channel walls defining longitudinal and spaced-apart retardation channels to decelerate a received sheared length of workpiece by sliding friction, and drive means to advance the channel walls of the run-out transfer means in a direction transversely to the sheared length of workpiece while supported thereby.

In the preferred form of the present invention, the entry guide means includes a guide tube supported by a carriage for pivotal movement between the first and second positions. Movement of the guide tube is controlled by a follower in contact with a cam coupled for rotation in timed relation with the movable shear knife. It is preferred to employ a flying shear having two shear knife assemblies rotating about spaced vertical axes such that by movement of the workpiece into the first position, the entry guide tube directs the workpiece for severance by the shear and when moved into the second position, the workpiece is directed along a vertically-spaced path above the rotating shear knives. The spaced-apart retardation channels of the run-out transfer means are carried by a rotating drum supported for rotation about a horizontal axis that extends in a generally parallel relation with the path of travel by the workpiece from the shear means. Rotation of the drum is controlled in a timed relation to rotation by the shear knives such that the retardation channels are continuously advanced in a lateral direction from the vertical plane at which the sheared length of workpiece is discharged from the shear means. For very high speeds, each retardation channel can include at its end remote to the shear means a stop in the form of a hydraulically-dampened shock absorber with a return spring. If shock absorbers are used, a shield is spaced above the retardation channels to prevent escapement and buckling of the sheared length of workpiece upon impact with the shock absorbers.

These features and advantages of the present invention as well as others will be more fully understood when the following description is read in light of the accompanying drawings, in which.

Figure 1:
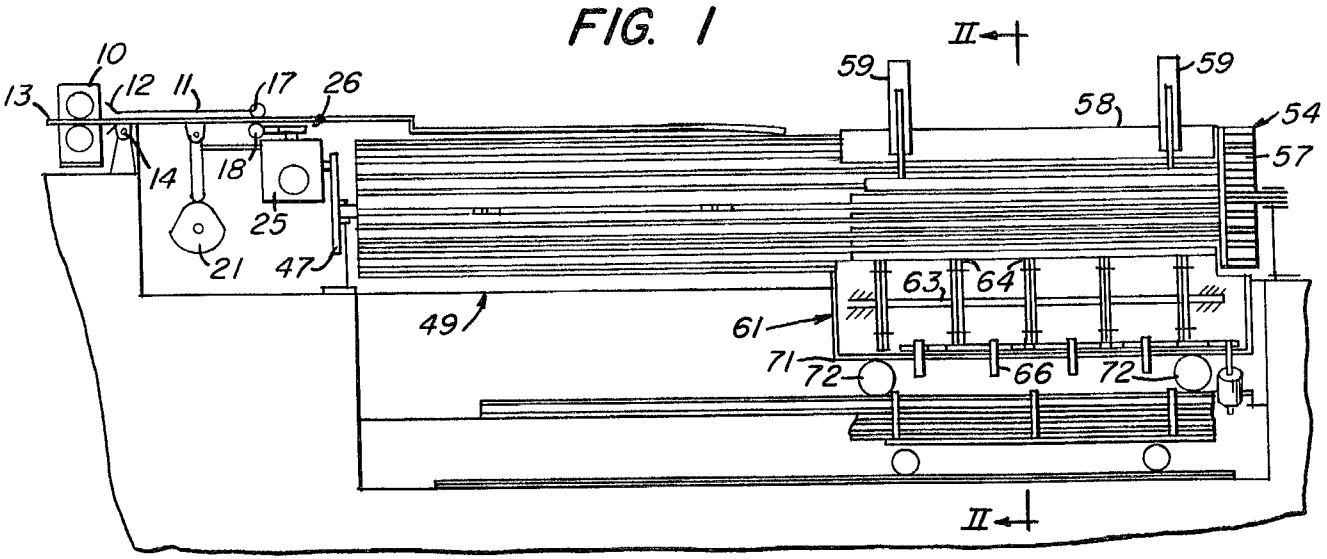
FIG. 1 is a side elevational view of a high-speed delivery system embodying the features of the present invention.

In FIG. 1, there is illustrated a rolling mill stand 10 which is the last stand of a rolling mill installation and preferably embodies a construction as disclosed in my aforesaid U.S. Pat. No. 3,945,234. The mill stand 10, for the purpose of disclosing the present invention, is the last one of a plurality of mill stands to process a workpiece for producing bars which may be of any desired size and cross-sectional configuration down to and including a $\frac{3}{8}$ inch diameter bar. The speed at which the bar is issued from the mill stand 10 is dependent upon the particular rolling mill operation; however, it is intended that delivery speeds of the bar up to 4000 feet per minute or even greater are possible for use with the delivery system according to the present invention.

Figure 2:
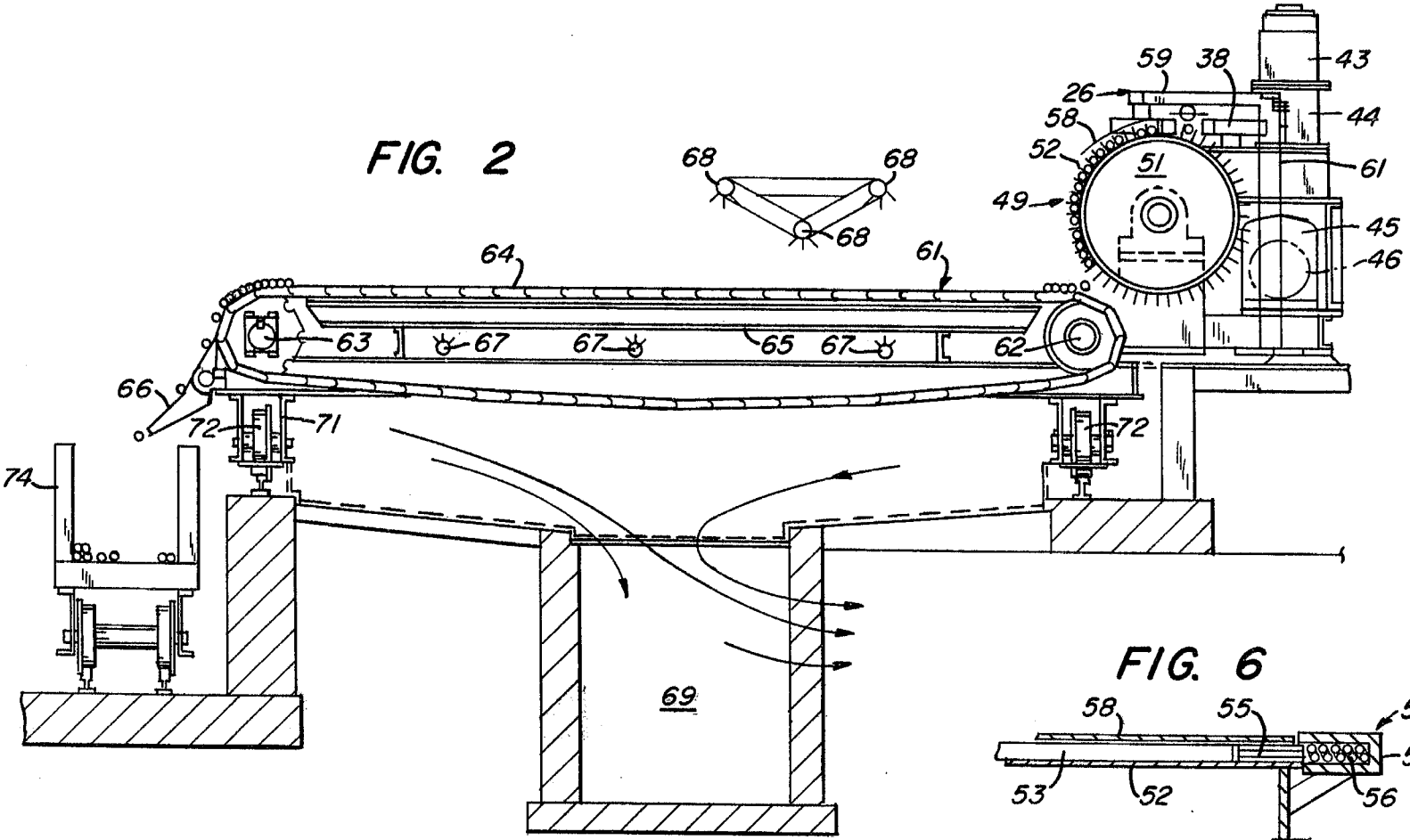
FIG. 2 is an end elevational view taken along line II—II of FIG. 1.
Figure 3:
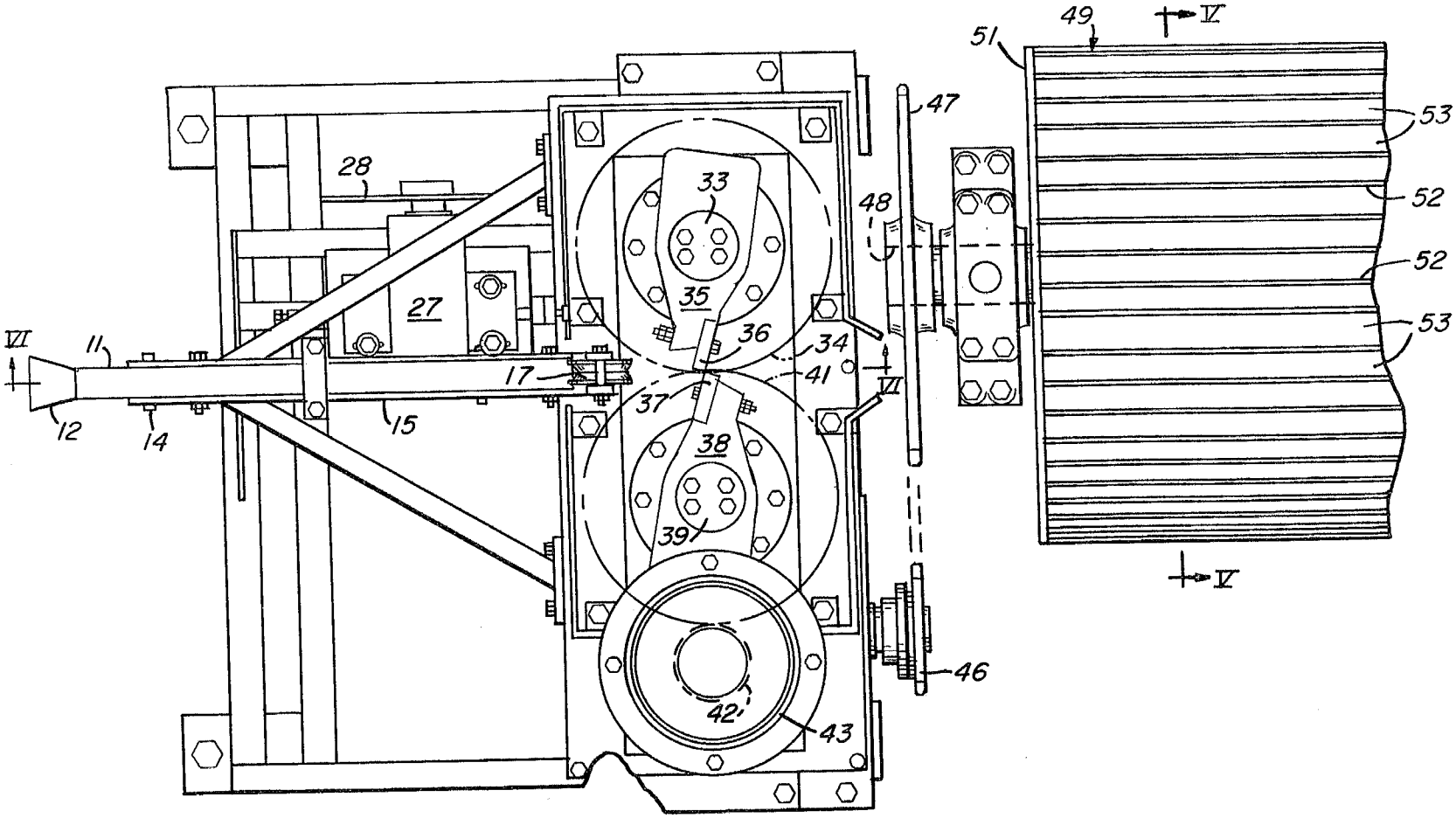
FIG. 3 is an enlarged plan view of the flying shear and guide for the high-speed delivery system shown in FIG. 1.
Figure 4:
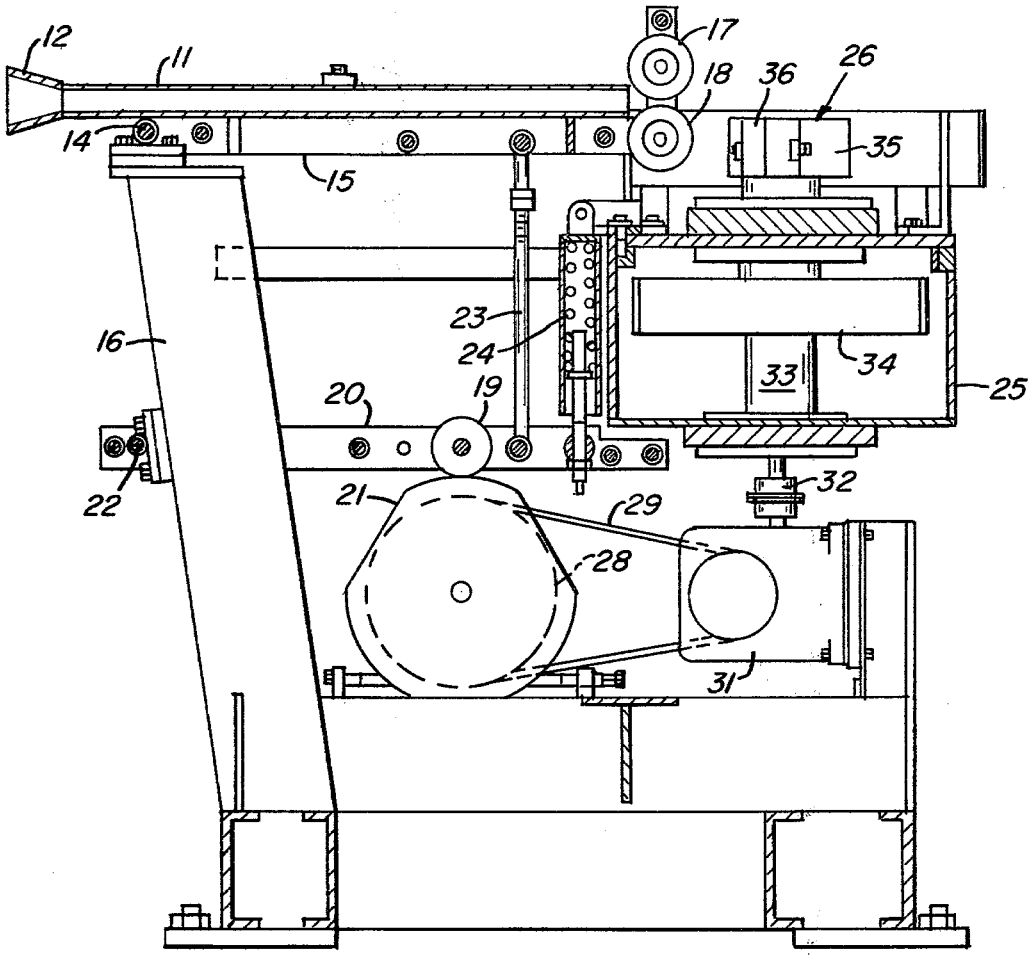
FIG. 4 is a sectional view taken along line IV—IV of FIG. 3.

At the delivery side of the mill stand 10, preferably closely adjacent thereto, is a guide tube 11 having a flared entry end 12 to direct the leading end of a bar 13 into the tubular passageway of guide 11. The discharge end of guide 11 is moved vertically about a horizontal axis formed by a hinge pin 14 which is adjacent the entry end of the guide 11. As shown in FIGS. 3 and 4, the guide is supported by a cradle that takes the form of a carriage 15 attached at one end by hinge pin 14 to a support pedestal 16. The opposite end of carriage 15 supports a frame for upper and lower guide rollers 17 and 18, respectively. These guide rollers are spaced apart so that a bar passing along the guide tube toward the discharge end passes into the gap between the rollers. The guide 11 and guide rollers 17 and 18 are pivotally moved in a vertical plane in a cyclic manner by a position controller that takes the form of a follower 19 carried by a frame 20 to contact the surface of a cam 21. Frame 20 extends to a pivot hinge 22 supported by pedestal 16. Link 23 connects the frame 20 to the carriage 15. A dashpot 24 is supported at one end by a bracket from a gearcase 25 of a flying shear 26. A spring-loaded plunger of the dashpot is connected to frame 20 to maintain contact between the follower 19 and the surface of cam 21. The cam is rotated by a drive shaft supported by bearings in a housing 27 (FIG. 3). A sprocket wheel 28 is attached to the end of the drive shaft that extends from the housing 27. Sprocket wheel 28 is coupled by a chain 29 to a sprocket on the drive output shaft of a gear reducer 31. The drive input shaft of the gear reducer is connected by a coupling 32 to an arbor 33 supported by bearings in the gearcase 25. Mounted on the arbor within the gearcase is a drive gear 34 and mounted onto the upper end portion of the arbor above the top of the gearcase is a holder 35 used to support a shear knife 36. Holder 35 and shear knife 36 are rotated about a vertical axis which is spaced from the vertical axis about which a shear knife 37 rotates while supported by a holder 38. Holder 38 is attached to the upper end of an arbor 39 which extends into the gearcase 25 and carries a gear 41 in meshing engagement with gear 34. A pinion gear 42 meshes with gear 41 while mounted on a drive shaft coupled to a motor 43. As shown in FIG. 2, the motor is supported by a pedestal 44 extending from the top surface of the gearcase so that the motor is supported above and at one side of the shear knives. The drive shaft coupled to the motor extends from the bottom of the gearcase where it is joined by a coupling to a right-angle gear reducer 45 having a sprocket wheel 46 on its output shaft. A chain couples sprocket wheel 46 to a sprocket wheel 47 on the outboard end of a drive shaft 48 carried by bearings for supporting a run-out transfer drum 49.

Figure 5:
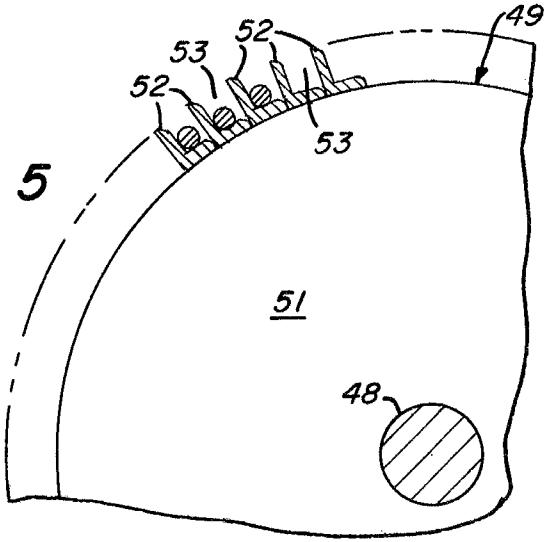
FIG. 5 is a sectional view taken along line V—V of FIG. 3.
Figure 6:
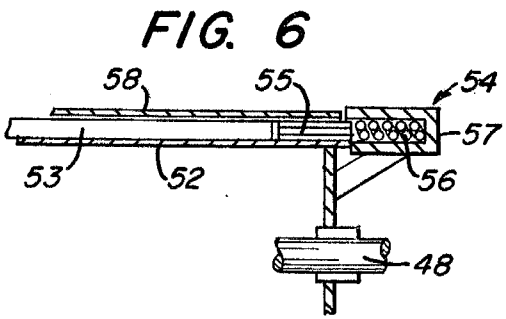
FIG. 6 is an enlarged view of the stop used in the run-out transfer of the high-speed delivery system shown in FIG. 1.

As shown in FIGS. 2, 3 and 5, drum 49 includes spaced-apart support discs 51 attached by welding, for example, to shaft 48 and carry on their outer peripheral edge a plurality of angle sections 52. The angle sections have a length corresponding to the length of the drum and define a generally L-shape in cross section. As shown in FIG. 5, the angle sections are attached by one leg to the peripheral edges of each disc 51 such that the other leg projects radially and forms with an adjacent leg of retardation channels 53. If desired, a plate can be bent to form a sleeve and used as an intermediate support for the angle members 52 upon the discs 51. The angle members 52 form the longitudinally, spaced-apart and parallel retardation channels 53 to decelerate sheared sections of workpieces by sliding frictional contact. The length of each channel is designed to support the entire length of a sheared bar. The end of the drum which is most remote to the shear 26 is provided with stop members 54 to prevent passage of the leading end of a bar beyond the drum. The stop members, as shown in FIG. 6, each includes a plunger 55 supported by a spring 56 within an opening formed in a housing 57 that is attached to the drum by a bracket for rotation therewith. The length of the plunger, the attachment point of the housing and/or support housing can be varied for desired positioning of the stop along the retardation channels. As shown in FIGS. 1 and 2, a bent plate forms a shield 58 carried by two arms 59 extending from a pedestal 61 to position the shield at a closely-spaced relation above a top arcuate segment of the drum. The shield prevents escapement of a bar from a channel during deceleration.

Each sheared length of a bar is carried by one of the channels 53 in a lateral direction to its extended length and lowered from an elevation corresponding to the vertical discharge path at about the vertical center plane of the drum 49 to a discharge point generally below the horizontal center plane of the drum. Depending upon the cross-sectional configuration of the bar, when the radially-extending wall section of the angle members is sloped at a downward angle with respect to the horizontal, the bar within the channel 53 moves under the influence of gravity from the channel onto a conveyor 61. The conveyor includes spaced-apart support shafts 62 and 63 that are generally parallel with one another and extend in the same general direction as the rotational axis of drum 49. Each shaft 62 and 63 carries sprocket wheels that engage one of a plurality of chains 64 that moves along a support 65 while carrying sheared lengths of bars in a lateral direction to their extended length from the point of discharge from drum 49 to a discharge chute 66. The support 65 carries spaced-apart pipes 67 having spray nozzles to direct water sprays upwardly into the space between the chain 64 for cooling the bars. Other pipes 68 are supported above the conveyor 61 and include nozzles to direct water sprays onto the bars while carried by the conveyor. An exhaust fan, not shown, draws air from a duct extending to a pit 69 to withdraw steam and fumes occurring during the cooling of bars on the conveyor. The shafts 62 and 63 of the conveyor are supported by suitable bearings on a carriage 71 supported by wheels 72 on rails that are spaced apart and extend in a generally parallel relation with the rotational axis of drum 49. By this construction and support arrangement for the conveyor, the conveyor is moved to the optimum workpiece-receiving position, that is, whenever the bar stops depending on its exit speed. When small and fast-moving bars are produced, the receiving station is at the end of the drum; while for large and slow-moving bars it is at the entry end section of the drum. The bars, after cooling on the conveyor, pass along chute 66 into a cradle 74 which may be part of a transfer car supported by wheels on rails for transporting a collection of cooled bars to a remote strapping and discharge station. While this occurs, a substitute cradle is moved into position to receive the cooled bars as they are continually discharged by the conveyor 61.

In the operation of the delivery system according to the present invention, the leading end of a bar discharged from mill stand 10 passes into the guide tube 11. At the exit end of the guide tube, the bar passes between guide rollers 17 and 18 along a generally horizontal path of travel. Before this occurs, however, the drive motor 43 is energized causing the shear knives 36 and 37 to rotate within a horizontal plane with the shear knives approaching a shearing relation at guide rollers 17 and 18 and continuing in their rotation into the shearing relation and then separating at a point more remote from the guide rollers. The arbors 33 and 39 are part of a drive system that includes gear reducer 31 coupled to rotate cam 22 which, in turn, functions as a position controller to cyclically position the guide tube. Such positioning occurs by pivotal movement of the guide tube about shaft 14, whereby the discharge end of the guide tube as well as guide rollers 17 and 18 move vertically from a first position wherein the bar is directed into the space between the shear knives and subdivided as the shear knives rotate into cooperative shearing relation. The second position by the guide tube directs the bar along a path of travel which is vertically spaced above the shear knives so that they continuously rotate but beneath the bar as it passes above the shear knives. The shear knives are supported in cantilever fashion so that the space above the knives is open. The arbors 33 and 39 may extend to bearing supports above the shear knives whereby the bar passes within the gap between the two arbors in the second position of the guide.

The leading end of each sheared length of bar spans the gap between the shear and the drum 49 due to the relatively high rate of travel and falls under the influence of gravity into a channel immediately underlying the front end of the bar. While the leading end of the bar moves along the channel toward a stop at the end thereof, the drum 49 is rotated by the chain-driven sprocket wheels 46 and 47 that are also driven by motor 43. The drum rotates at a relatively slow speed which is selected according to the diameters of the sprocket wheels so that by the time the trailing end of a sheared length of bar moves into the channel of the drum, the rotation of the drum is such that the next adjacent channel is aligned to receive the leading end of the remaining length of bar before it is sheared to length.

The shear knives are continuously rotated by the drive motor 43 which is controlled so that the peripheral knife speed is synchronized with the speed of the bar issuing from the mill. This speed synchronization can be controllably varied within a narrow limit, e.g., $\pm 5\%$, to obtain precise lengths of sheared workpieces. Each revolution of the shear knife represents a given length of workpiece such that by counting the revolutions of the shear and moving the guide tube into the passline of the shear after certain multiple revolutions, the workpiece is cut into predetermined lengths. The cam 22 as shown in the drawings has three lobes which are driven continuously by the same motor used to rotate the shear knives, but through gear reducer 31 and sprocket wheel 28. By changing the number of teeth in the chain sprockets, the sheared lengths of bars can be varied. Also by changing the number of lobes on the cam, the lengths of the sheared bars can be changed. The horizontally-operating shear in combination with the guide tube 11 and the multichannel drum 49 insure separation of the tail end of a sheared bar from the front end of the remaining length of the bar. The front end of the newly-sheared bar will slide past the tail end of the sheared bar without interference because the drum rotates at a selected speed in relation to rotation by the shear knives. A new channel 53 is presented each time the shear knives cut the bar. By taking advantage of gravity, the sheared length of bar is permitted to fall into a channel of the deceleration drum whereby further or additional guiding is unnecessary. Because the drum is continually rotated at a relatively slow speed, the sheared length of bar will always fall into an empty channel. The horizontal rotation of the shear facilitates separation between the sheared surfaces of the bar because one knife pushes the tail end of the bar to one side; while the remaining knife pushes the front end of the bar to the other side. Gravity moves the tail end of the sheared bar downwardly while the guide tube and rollers 17 and 18 lift the front end of the remaining length of the bar, thus completing the necessary separation. The shock absorbers avoid buckling of very thin bars and the shield 58 prevents buckling of the bar upon impact with the stop. The necessary width of the conveyor 61 can be at a minimum since all the workpieces are at one relative location on the drum with their leading ends lined up at the end of the drum against the stop members. The conveyor 61 is independently driven to allow changing of the cooling rate and spacing of workpieces of different sizes. Moreover, by moving the conveyor along the drum, large bars that move too slowly into the drum to reach the end of the drum are still discharged onto the conveyor.

To employ the above system for small angles, for example, it would be preferable to rearrange the shear system by 90° so that the shear arbors have a horizontal axis. In that case, the product passline and entry to the drum would remain the same, but the guide tube would move sideways instead of up and down.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A delivery system to process a hot workpiece discharged from a rolling mill or the like at a high speed by cutting it into finished lengths, decelerating the pieces and cooling the pieces, said delivery system including the combination of:

shear means including a drive coupled to a movable shear knife to subdivide a workpiece into sections having desired lengths, said shear means having an entry side, a delivery side and a passageway for a workpiece to pass by said movable shear knife, entry guide means including a position controller to cyclically position a segment of a moving workpiece at said entry side of the shear means between a first position wherein the workpiece is directed for subdivision by contact with said movable shear knife and a second position wherein a workpiece is directed along a path spaced from said movable shear knife to the delivery side of said shear means, run-out transfer means closely spaced from and adjacent the delivery side of said shear means to receive successive sheared sections of a hot workpiece guided essentially by said entry guide means for cooling and transfer in a lateral direction of the length of the sheared sections, said run-out transfer means including radially-extending channel walls defining longitudinal and spaced-apart retardation channels to receive a sheared section of a workpiece by dropping vertically into one channel directly from said shear means for deceleration by sliding friction, said second position of the entry guide means directing the leading end of a sheared workpiece through the space between the shear means and the run-out transfer means at an elevation generally above said retardation channels, and drive means to advance said channel walls of the run-out transfer means in a direction transversely to the length of said sheared sections while supported thereby.

2. The handling system according to claim 1 further including stop means to prevent longitudinal movement of a sheared section of a workpiece from said retardation channels at the ends thereof remote to said shear means.

3. The handling system according to claim 2 wherein said stop means includes a hydraulically-dampened shock absorber with a return spring.

4. The handling system according to claim 1 wherein said entry guide means includes a guide tube to receive a workpiece therein at the entry side of said shear means.

5. The handling system according to claim 4 wherein said entry guide means further includes a carriage supporting said guide tube for movement between said first position and said second position, and wherein said position controller includes a driven cam and a follower for moving said carriage and the guide tube supported thereby.

6. The handling system according to claim 5 further including speed reducer means rotatably interconnecting said driven cam and said drive of the shear means.

7. The handling system according to claim 1 wherein said shear means includes spaced-apart drive shafts having vertical axes of rotation, each drive shaft rotating a shear knife into and out cooperative shearing relation with a moving workpiece.

8. The handling system according to claim 7 wherein said entry guide means includes a guide tube supported for pivotal movement about a horizontal axis to vertically pivot said guide tube into said second position wherein a workpiece is directed above said pair of shear knives.

9. The handling system according to claim 1 or 7 further including means to rotatably interconnect said position controller and said drive of the shear means.

10. The handling system according to claim 1, 2 or 3 wherein said run-out transfer means includes a shield spaced above said retardation channels to prevent buckling of a sheared section of a workpiece during deceleration.

11. The handling system according to claim 1 wherein said run-out transfer means includes a drum with bearing supports carrying the drum for rotation about a horizontal axis extending in a generally parallel relation with said retardation channels, said channel walls being defined by web sections projecting radially from a workpiece support surface on the drum.

12. The handling system according to claim 1 or 11 wherein said drive means includes a speed reducer driven in response to rotation by said drive coupled to a movable shear knife.

13. The handling system according to claim 1 further comprising a transfer conveyor receiving workpieces from said run-out transfer means for continued cooling while advanced laterally in relation to their extended lengths.

14. The handling system according to claim 13 further including means to movably position said transfer conveyor to receive sheared sections of a workpiece at a desired location along the length of said retardation channels.

15. The handling system according to claim 14 further comprising a means to force-cool workpieces while transferred by said transfer conveyor.

16. The handling system according to claim 1 wherein said movable guide means includes spaced-apart rollers to guide a workpiece when passed therebetween.

17. The handling system according to claim 13 further including means to collect cooled sheared lengths of workpieces after advancement by said transfer conveyor.

18. The handling system according to claim 13 further including cradle means to collect cooled sheared lengths of workpieces from said transfer conveyor, and means to temporarily accumulate cooled sheared lengths of workpieces at the discharge side of said transfer conveyor during removal of collected lengths of workpieces from said cradle means.

19. The handling system according to claim 2 further including means to movably position said stop means into a desired position along said retardation channels.

* * * * *